United States Patent [19]

Melocik

[11] Patent Number: 4,469,007

[45] Date of Patent: Sep. 4, 1984

[54] SINGLE LEVER CONTROL WITH AUTOMATIC VALVE LATCHING

[75] Inventor: Kurt B. Melocik, Mazon, Ill.

[73] Assignee: Caterpillar Tractor Co., Peoria, Ill.

[21] Appl. No.: 433,111

[22] PCT Filed: Nov. 20, 1981

[86] PCT No.: PCT/US81/01545

§ 371 Date: Nov. 20, 1981

§ 102(e) Date: Nov. 20, 1981

[87] PCT Pub. No.: WO83/01820

PCT Pub. Date: May 26, 1983

[51] Int. Cl.[3] ..... F15B 13/08

[52] U.S. Cl. ..... 91/358 A; 91/522; 91/529; 91/530; 137/596.15; 137/636.2

[58] Field of Search ..... 91/358 R, 358 A, 522, 91/529, 530; 137/596.15, 596.16, 636.2

[56] References Cited

U.S. PATENT DOCUMENTS

| | | | |
|---|---|---|---|
| 3,823,647 | 7/1974 | Campbell et al. | 91/358 A |
| 3,883,783 | 5/1975 | Fuzzell | 317/148.5 R |
| 4,011,959 | 3/1977 | Papasideris | 214/762 |

FOREIGN PATENT DOCUMENTS 1494400 11/1977 United Kingdom .

*Primary Examiner*—Gerald A. Michalsky
*Attorney, Agent, or Firm*—J. W. Burrows

[57] ABSTRACT

A single lever pilot control system (10) controls the simultaneous operation of two actuators (16,18). A mechanism (48) holds a first control valve (20) in an actuated position in response to movement of the handle (29) along a first axis (44) while freeing the handle (29) to return to a neutral position. Further movement of the handle (29) along a different axis to operate the second actuator (18) does not override the automatic stopping of the first actuator (16). The mechanism (48) provides a more precise control of automatically stopping one actuator while simultaneously operating the second actuator.

18 Claims, 2 Drawing Figures

SINGLE LEVER CONTROL WITH AUTOMATIC VALVE LATCHING

DESCRIPTION

1. Technical Field

This invention is directed to a single lever pilot control system and more particularly to a mechanism to maintain a main control valve in an actuated position while freeing the single lever pilot control to return to a neutral position.

2. Background Art

In many single lever control systems known today, a single lever pilot control can be moved along one axis to an actuated position to actuate a first actuator and along a different axis to actuate another actuator while the lever is held in the first actuated position. Some such systems also have a detent mechanism to hold the single lever pilot control in the first actuated position and a release mechanism to automatically release or override the detent mechanism in response to the first actuator reaching a predetermined position. One of the problems encountered with the latter systems occurs when the pilot control is manually moved along the different axis while being held in the first actuated position by the detent mechanism. When the detent mechanism suddenly automatically releases, the pilot control is sometimes inadvertently held in the first actuated position temporarily by the operator and thereby cause the actuator to overrun the desired stop position.

DISCLOSURE OF THE INVENTION

In one aspect of the invention, a pilot operated system has first and second pilot operated control valves each movable between a neutral position and first and second actuated positions. The system has a single lever pilot control valve movable between a neutral position and a plurality of other positions for controlling the actuation of the first and second pilot operated control valves. A means holds the first pilot operated control valve at the first actuated position while freeing the single lever pilot control valve to return to the neutral position.

This invention solves the problem of the actuator not stopping at the desired position caused by the operator inadvertently holding the single lever valve in an actuated position once the detent mechanism is released. The mechanism of this invention frees the single lever control to return to the neutral position after actuating the first pilot operated control valve to move the first actuator. Consequently, simultaneous actuation of the second actuator will not result in an override of the desired stop position of the first actuator upon automatic release of the first pilot operated control valve. This results in more precise control of the first actuator's stop position.

BEST MODE FOR CARRYING OUT THE INVENTION

Figures 1, 2:
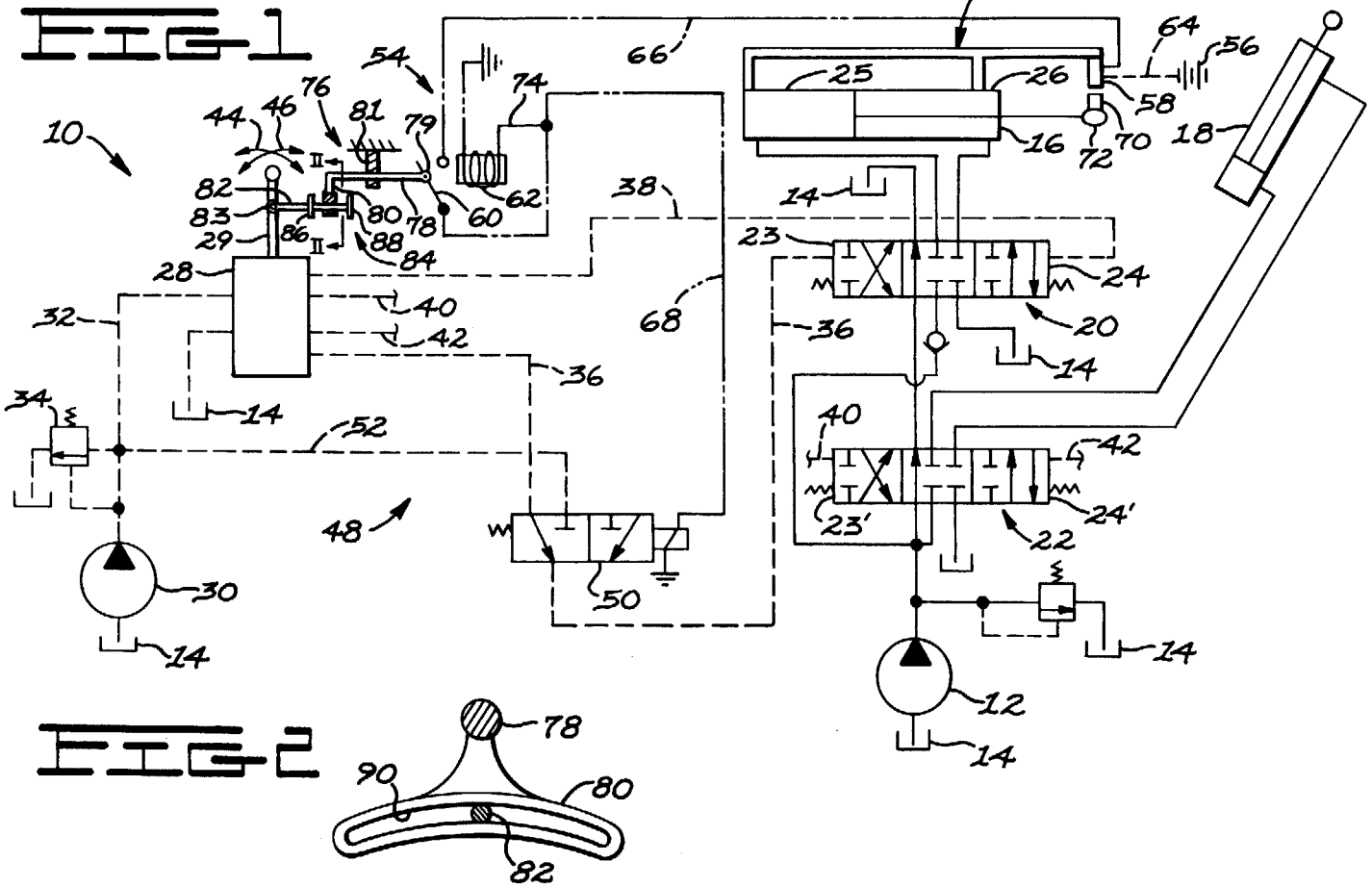
FIG. 1 is a partial schematic and diagrammatic representation of an embodiment of the present invention.
FIG. 2 is a diagrammatic view II—II taken from FIG. 1 to better illustrate a portion of the single lever control mechanism.

Referring now to FIG. 1, a pilot operated control system is generally indicated by reference numeral 10 and includes a source of pressurized fluid, such as, a pump 12 receiving fluid from a tank or reservoir 14 and first and second actuators 16, 18 connected to the pump 12 and each movable between first and second positions. As is well known in the art, first and second pilot operated control valves 20, 22 controllably direct fluid from the pump 12 to the first and second actuators 16, 18. The first and second control valves 20, 22 are movable between a spring biased, neutral position and first and second actuated positions by directing pressurized fluid to each end 23, 24, and 23', 24' respectively in a conventional manner. Since both control valves 20, 22 operate in the same manner, reference will be directed only to the first control valve 20 and the first actuator 16. At the neutral position, as shown, the flow from the pump 12 is blocked from the actuator 16 and is free to pass to the tank 14 through the control valves 20, 22 since, as shown, they are both in the neutral position. At the first actuated position of the first control valve 20, the flow from the pump 12 is directed to a head end 25 of actuator 16 and blocked from the tank 14. At the second actuated position of the control valve 20, the flow from the pump 12 is directed to a rod end 26 of the actuator 16 and blocked from the tank 14. Flow from the pump 12 to the head end 25 of the actuator 16 moves the actuator 16 from a first position shown to a second, extended position. Conversely, flow to the rod end 26 moves the actuator 16 from the second, extended position to the first position, as shown. The actuator 16 may be retracted past the first position as desired by the operator.

A single lever pilot control valve 28 controls the actuation of the first and second control valves 20, 22. The single lever valve 28 has a handle 29 movable between a neutral position and a plurality of other positions to individually or simultaneously control actuation of the first and second control valves 20, 22 as more fully described in British Pat. No. 1,494,400, published on Dec. 7, 1977.

A source of pressurized pilot fluid, such as, a pilot pump 30 is connected to the single lever valve 28 by a conduit 32. A relief valve 34 is connected to the conduit 32 to establish a predetermined pressure in a conventional manner.

The single lever valve 28 is connected to the ends 23, 24 of the first control valve 20 through first and second conduits 36, 38 and to the ends 23', 24' of the second control valve 22 through third and fourth conduits 40, 42. The handle 29 of the single lever valve 28 is movable through a first axis 44 for controllably directing fluid from the pilot pump 30 to actuate the first control valve 20 and move the first actuator 16 between the first and second positions. The handle 29 is also movable through a second axis 46 for controllably directing fluid from the pilot pump 30 to actuate the second control valve 22 and move the second actuator 18.

A means 48 is provided for holding the first control valve 20 at the first actuated position while freeing the handle 29 to return to the neutral position. The holding means 48 includes a two position valve 50 located in the first conduit 36 and connected to the pilot pump 30 by a conduit 52. The two position valve 50 is movable between first and second positions. At the first, spring biased position, as shown, controlled fluid from the single lever valve 28 is communicated to the end 23 of the first control valve 20 through the conduit 36 while fluid from the pilot pump 30 through the conduit 52 is blocked. At the second position of the two position vavle 50, fluid communication from the single lever valve 28 is blocked and fluid from the pilot pump 30 is communicated directly to the end 23 of the first control valve 20.

The two position valve 50 is a solenoid actuated valve and the holding means 48 further includes an electrical control means 54 for energizing or de-energizing the solenoid actuated valve 50 in response to movement of the handle 29 from the neutral position to a preselected one of the plurality of positions. The electrical control means 54 includes a source of electrical eneregy, such as a battery 56, first and second switches 58, 60 and a latching relay 62 all respectively connected by electrical leads 64, 66, 68 to the solenoid actuated valve 50.

The first switch 58 is mounted on the first actuator 16 by a bracket assembly 69 and connected to the electrical source 56 by electrical lead 64. The first switch 58 is adapted to be open at the first position of the actuator 16 and closed at all other positions. The first switch 58 is a normally closed proximity switch which is actuated to an open position in a known manner by application thereto of a magnetic field. The magnetic field is supplied by a permanent magnet 70 attached to a rod portion 72 of the first actuator 16. In the first position of the first actuator 16, as shown, the first switch 58 is held open by the permanent magnet 70 being directly adjacent the normally closed first switch 58.

The second switch 60 is a normally open switch located in series between the first switch 58 and the solenoid actuated valve 50 and is movable to a closed position in response to movement of the handle 29 to the preselected position along the first axis 44. The second switch 60 is connected to the first switch 58 and the solenoid actuated valve 50 by the electrical leads 66, 68 respectively.

The latching relay 62 is located adjacent the second switch 60 and is adapted to hold the second switch 60 closed in response to closing of the second switch. An electrical lead 74 connects the latching relay 62 to the electrical lead 68. Upon closing of the first and second switches 58, 60, electrical energy from the electrical source 56 acting through the latching relay 62 holds the second switch 60 closed.

A linkage mechanism 76 connects the second switch 60 to the handle 29 of the single lever valve 28. The linkage mechanism 76 includes a first link 78 slidably disposed in a stationary mount 81. The first link 78 has first and second end portions 79, 80 with the first end portion 79 connected to the second switch 60. A second link 82 is slidably coupled to the second end portion 80 of the first link 78. The second link 82 has first and second end portions 83, 84 with the first end portion 83 connected to the handle 29 of the single lever valve 28. The second end portion 84 is slidably coupled to the first link 78 at the second end portion 80. A first stop member 86 is mounted on the second end portion 84 of the second link 82 on one side of the second end portion 80 of the first link 78 and an override means, such as a second stop member 88, is mounted on the second end portion 84 on the other side of the second end portion 80. The first stop 86 engages and moves the first link 78 to a position for closing the second switch 60 at the preselected position of the handle 29. The second stop 88 engages the first link 78 for manually overriding the latching relay 62 and opening the second switch 60 in response to the handle 29 being moved past neutral in the opposite direction.

Referring to FIG. 2, a lost motion means, such as, an arcuate slot 90 is located in the second end portion 80 of the first link 78. The second end portion 84 of the second link 82 is slidably disposed in the arcuate slot 90. The arcuate slot 90 is transverse to the first end portion 79 of the first link 78. The arcuate slot 90 permits movement of the handle 29 of the single lever valve 28 along the axis 46 for actuation of the second actuator 18. The first stop 86 initiates engagement of the second switch 60 through the first link 78 while the slidable connection between the second end portion 84 of the second link 82 and the second end portion 80 of the first link 78 frees the handle 29 of the single lever valve 28 to return to the neutral position with the second switch 60 remaining closed.

Industrial Applicability

The present invention has particular utility in control systems having a single lever control valve for controlling two functions, such as tilt and lift on a loader, wherein simultaneous operation of both functions by an operator does not override the automatic stop position of one function.

To initiate operation of the first and second actuators 16, 18, the operator moves the handle 29 along the axes 44, 46. Movement of the handle 29 to the left, as viewed in the drawing, along the axis 44 controllably directs pressurized fluid from the pilot pump 30 through the single lever valve 28 and second conduit 38 to the end 24 of the first control valve 20 for controllably moving the first control valve 20 from the neutral position to the first position. At the first position, pressurized fluid from the pump 12 is directed to the head end 25 of the first actuator 16 to extend the actuator from the first position to the second position. Movement of the handle in the opposite direction along axis 44 controllably directs pressurized pilot fluid to the end 23 of the first control valve 20 through conduit 36 to move the first control valve 20 to the second position. At the second position pressurized fluid from the pump 12 is directed to the rod end 26 of the actuator 16 to retract the actuator from the second position to the first position.

Movement of the handle 29 to the extreme right along the axis 44 closes the second switch 60 through the linkage mechanism 76. With the first actuator 16 at the second position, the first switch 58 is closed directing the electrical energy from the battery 56 through switch 60 and simultaneously to the latching relay 62 and the solenoid actuated valve 50 through the electrical leads 64, 66, 68, 74. The electrical energy actuates the solenoid actuated valve 50 moving it to the second position which blocks fluid from the single lever valve 28. At the second position, fluid from the pilot pump 30 is directed to the end 23 of the first control valve 20 through conduits 52 and 36 for holding the first control valve 20 in the second actuated position. The electrical energy energizes the latching relay 62 holding the second switch 60 closed while freeing the handle 29 to return to the neutral position. Upon the first actuator 16 reaching the first position, the permanent magnet opens the first switch 58 interrupting the flow of electrical energy. This interruption releases the latching relay 62 freeing the second switch 60 to open. Simultaneously, the solenoid actuated valve 50 is de-energized returning it to the first position. Since the single lever valve 28 is in the neutral position there is no fluid pressure in conduit 36, consequently the first control valve 20 returns to the neutral position.

Movement of the handle 29 along the axis 46 controllably directs pilot fluid from the pilot pump 30 selectively through the third and fourth conduits 40, 42 to the ends 23', 24' to move the second control valve 22 selectively between the neutral position and first and second actuated positions. The selective movement of the second control valve 22 controls the movement of the second actuator 18 in a conventional manner.

The linkage mechanism 76 provides free movement along the axis 46 without affecting the opening or closing of the second switch 60 since the second end portion 84 of the second link 82 slides in the arcuate slot 90 located in the second end portion 80 of the first link 78. Consequently, moving the handle 29 to the extreme right along axis 44 closes second switch 60 automatically actuating and holding the first control valve 20 at the second position to retract the actuator 16. This frees the handle 29 to return to the neutral position. Any movement of the handle 29 along the axis 46 does not override the automatic stopping of the first actuator 16 at the first position since the handle 29 is at the neutral position relative to axis 44.

With the use of the holding means 54, a single lever valve 28 provides simultaneous operation of the second function without affecting the automatic stopping of the first function.

Other aspects, objects and advantages of this invention can be obtained from a study of the drawing, disclosure and appended claims.

I claim:

1. In a pilot operated system (10) having first and second pilot operated control valves (20,22) each movable between a neutral position and first and second actuated positions, and a single lever pilot control valve (28) movable between a neutral position and a plurality of other positions for controlling the actuation of the first and second pilot operated control valves (20,22), the improvement comprising:

means (48) for holding the first pilot operated control valve (20) at the first actuated position while freeing the single lever pilot control valve (28) to return to the neutral position.

2. The pilot operated system (10), as set forth in claim 1, wherein said holding means (48) is responsive to movement of said single lever pilot control valve (28) to a preselected position for actuation of said first control valve (20) to the first position.

3. The pilot operated system (10), as set forth in claim 1, including a source (30) of pressurized pilot fluid, said single lever pilot control valve (28) having a handle (29) and being connected to one end (23) of said first pilot operated control valve (20) by a pilot conduit (36), said holding means (48) includes a two position valve (50) located in said pilot conduit (36) and movable between a first position communicating pilot fluid from the single lever pilot control valve (28) to the one end (23) of the first pilot operated control valve (20) and a second position blocking said communicating and communicating said source (30) of pilot fluid directly to said one end (23) of the first pilot operated control valve (20).

4. The pilot operated system (10), as set forth in claim 3, wherein movement of said two position valve (50) between the first and second positions is responsive to movement of said handle (29) of the single lever pilot control valve (28).

5. The pilot operated system (10), as set forth in claim 4, wherein the two position valve (50) is a solenoid actuated two position valve.

6. The pilot operated system (10), as set forth in claim 5, wherein said holding means (48), further includes an electrical control means (54) for energizing or de-energizing the solenoid actuated two position valve (50).

7. The pilot operated system (10), as set forth in claim 6, wherein the electrical control means (54) includes a source (56) of electrical energy, a first switch (58) located between the source (56) of electrical energy and the solenoid actuated control valve (50), a second switch (60) located between the first switch (58) and the solenoid actuated control valve (50) and movable to a closed position in response to movement of said handle (29) of the single lever pilot control valve (28) along an axis (44) to the preselected position, and a latching relay (62) adapted to hold the second switch (60) closed in response to closing of the second switch (60).

8. The pilot operated system (10), as set forth in claim 7, wherein said holding means (48) includes a linkage mechanism (76) connected between the handle (29) and the second switch (60), the linkage mechanism includes a first link (79) connected to the second switch (60), and a second link (82) connected to the handle (29) and slidably coupled with the first link (79).

9. The pilot operated system (10), as set forth in claim 8, wherein the linkage mechanism (76) has a lost motion means (90) for providing movement of the linkage mechanism (76) to close the second switch (60) at the preselected position of handle (29) and for providing unrestricted movement of the handle (29) along a second axis (46).

10. The pilot operated system (10), as set forth in claim 9, wherein the linkage mechanism (76) includes override means (88) for overriding the latching relay (62) and opening the second switch (60) in response to moving the handle (29) along the axis (44) beyond the neutral position opposite from the preselected position.

11. The pilot operated system (10), as set forth in claim 10, including an actuator (16) having the first switch (58) mounted thereon and movable between a first position at which said first switch (58) is open and a second position at which said first switch (58) is closed.

12. The pilot operated system (10), as set forth in claim 11, wherein said actuator (16) is movable from the second position to the first position in response to the handle (29) of the single lever pilot control valve (28) being moved to the preselected position.

13. The pilot operated system (10), as set forth in claim 12, wherein the latching relay (62) releases the second switch (60) at the first position of the actuator (16).

14. A control system (10), comprising:

a source (12) of pressurized fluid;

first and second pilot operated control valves (20,22) having first and second ends (23,24,23',24') and connected to said source (12) and movable between first, second and third positions;

first and second actuators (16,18) connected to the first and second pilot operated control valves (20,22) respectively and movable between first and second positions;

a source (30) of pressurized pilot fluid;

a single lever pilot control valve (28) having a handle (29) and connected to the source (30) of pressurized pilot fluid and to the first and second ends (23,24,23',24') of the first and second pilot operated control valves (20,22), the handle (29) being movable between a neutral position and a plurality of other positions to control the movement of the first and second pilot operated control valves (20,22), and means (48) for holding the first pilot operated control valve (20) at the second actuated position while freeing the handle (29) of the single lever pilot control valve (28) to return to the neutral position.

15. The control system (10), as set forth in claim 14, wherein said holding means (48), includes a solenoid actuated valve (50) located between the single lever pilot control valve (28) and the first end (23) of the first pilot operated control valve (20) and adapted to selectively communicate the fluid from the single lever pilot control valve (28) and the source (30) of pressurized pilot fluid to the first end of the first pilot operated control valve (20); and electrical control means (54) for controlling the actuation of the solenoid actuated valve (50) to a position communicating the source (30) of pressurized pilot fluid to the first end (23) in response to the handle (29) of the single lever pilot control valve (28) being moved to a preselected one of its plurality of positions.

16. The control system (10), as set forth in claim 15, wherein the electrical control means (54) includes a source (56) of electrical energy;

a normally open switch (60) connected to the source (56) of electrical energy and movable to a closed position in response to the handle (29) of the single lever pilot control valve (28) being moved to the preselected one of its plurality of positions.

17. The control system (10), as set forth in claim 16, further including a latching relay (62) associated with the switch (60) and adapted to hold the switch (60) closed in response to movement of the handle (29) of the single lever pilot control valve (28) to the neutral position.

18. The control system (10), as set forth in claim 17, including a normally closed switch (58) located between the source (56) of electrical energy and the normally open switch (60) and adapted to release the normally open switch (60) in response to opening of the normally closed switch (58).

* * * * *